US005664565A

United States Patent [19]

Pietrelli

[11] Patent Number: 5,664,565

[45] Date of Patent: Sep. 9, 1997

[54] REGULATOR FOR UNDERWATER BREATHING APPARATUS FOR DIVING IN COLD WATERS

[75] Inventor: Nino Pietrelli, Sori, Italy

[73] Assignee: HTM Sport S.p.A., Italy

[21] Appl. No.: 633,493

[22] Filed: Apr. 17, 1996

[30] Foreign Application Priority Data

May 12, 1995 [IT] Italy ..... GE95A0054

[51] Int. Cl.[6] ..... A62B 7/04

[52] U.S. Cl. ..... 128/205.24; 128/204.26; 128/205.22; 128/204.18

[58] Field of Search ..... 128/204.26, 205.22, 128/204.18, 205.24

[56] References Cited

U.S. PATENT DOCUMENTS

| | | | |
|---|---|---|---|
| 4,214,580 | 7/1980 | Pedersen | 128/204.26 |
| 4,356,820 | 11/1982 | Trinwalder, Jr. . | |
| 5,052,383 | 10/1991 | Chabert | 128/204.26 |
| 5,265,596 | 11/1993 | Sauze | 128/204.26 |

*Primary Examiner*—V. Millin
*Assistant Examiner*—William J. Deane, Jr.
*Attorney, Agent, or Firm*—Larson and Taylor

[57] ABSTRACT

Regulator for underwater breathing apparatus comprising a box-like body of plastic material, from which a tube provided with mouthpiece, and equiped with an outlet port branches out. The box-like body of said regulator is provided with one or more metallic inserts integrated in the walls of said body.

3 Claims, 1 Drawing Sheet

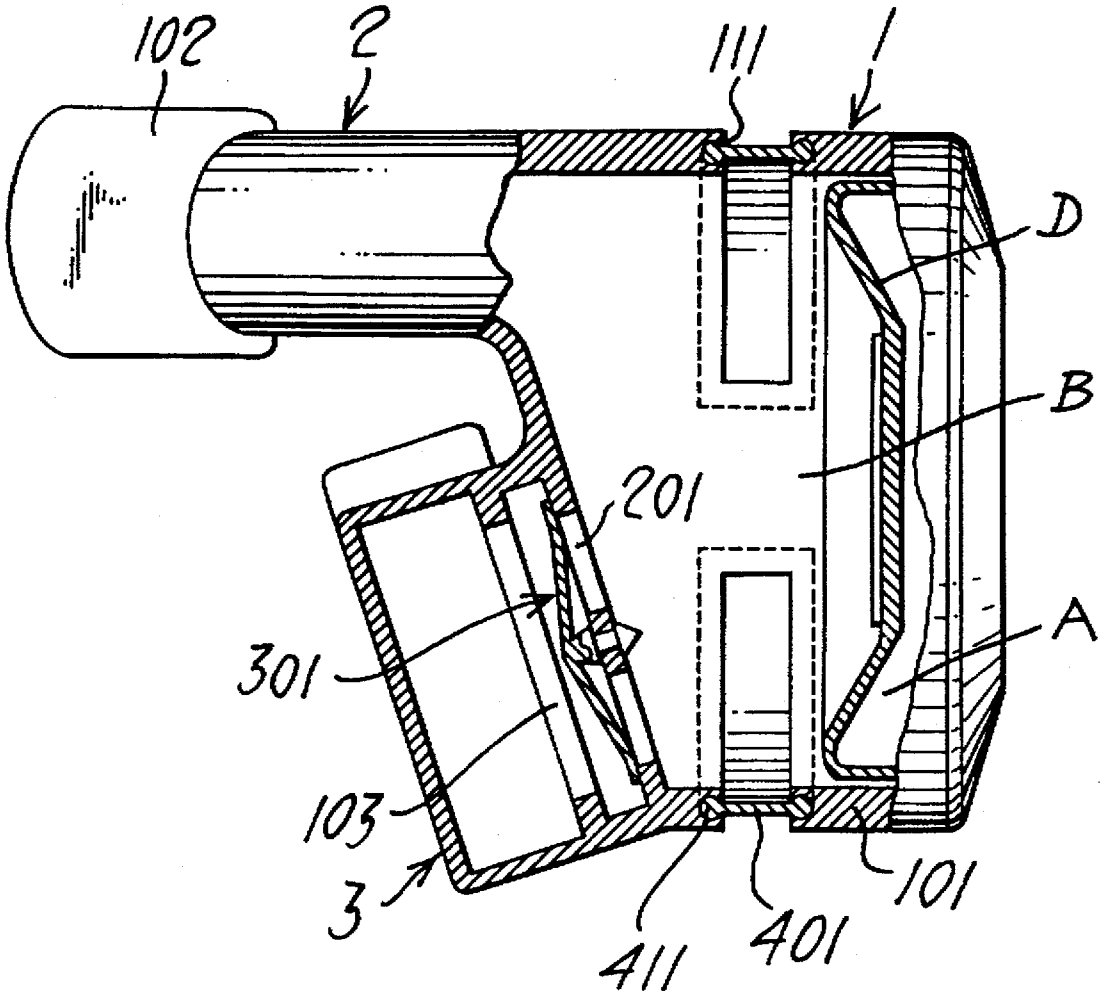
1
2
102
111
D
B
A
101
401
411
201
301
103
3

REGULATOR FOR UNDERWATER BREATHING APPARATUS FOR DIVING IN COLD WATERS

BACKGROUND OF THE INVENTION

1. Field of the Invention

The present invention relates to the regulators for underwater breathing apparatus.

Such regulators comprise a box-like body to which a tube provided of mouthpiece is connected, the said body being made from metal or plastic material.

Obviously, the realization in plastic material is the one that results economically more advantageous, since the regulator is particularly light and handy, and it results also obtainable at restrained costs.

However, it has been found that, in particular during diving in very cold waters (about 0° C.) such a regulator presents some drawbacks. In fact some encrustations of ice might form easily on the inside of it, which are due to the freezing of the steam caused by the expansion of the air into the plastic material body, which is diathermic. On the contrary this does not occur with the regulators provided with a metal body, because the latter allows a steady thermic exchange with the environment.

2. Description of Related Art

From U.S. Pat. No. 4,356,820 a regulator is known for underwater breathing apparatus comprising a box-like body made of molded plastic material. In order to prevent freeze-up of the air supply valve mechanism and actuator under cold water environments, the regulator is provided with a heat conducting element having a first portion so located to receive heat from the user's breath and having a second portion in heat transferring relation to the valve mechanism whereby heat is transferred from the user's breath to the valve mechanism for preventing freeze-up of the valve mechanism under cold ambient conditions.

However, also this regulator construction is unsuited to prevent the formation of ice encrustations on the inside of the regulator.

SUMMARY OF THE INVENTION

Purpose of the invention is to provide a regulator which is able to efficiently exchange heat with the exterior, like the regulators provided with a metallic body, whilst maintaining the characteristics of handiness, lightness and economy of realization of the regulators having a body made of plastic material.

Therefore it is the object of the present invention to provide a regulator for underwater breathing apparatus comprising a box-like body of plastic material, from which a tube provided with a mouthpiece departs, and provided with an outlet port, characterized by the feature that the said box-like body of the regulator is provided with one or more metallic inserts integrated in said body.

Commonly said box-like body has a substantially cylindrical shape, and said inserts are disposed on its side wall, in the shape of one or more annular sectors.

BRIEF DESCRIPTION OF THE DRAWING

Further advantages and characteristics will result from the following description of an embodiment of the present invention made with reference to the enclosed single drawing, which is a partially sectioned elevational side view of a regulator according to the present invention.

DESCRIPTION OF THE PREFERRED EMBODIMENT

With reference to the FIGURE, with reference number 1 the cylindrical box-like body of the regulator is designated. Said body, made from plastic material, includes a diaphragm D separating the interior of the body in a first chamber A in communication with the ambient and a second chamber B containing in its inside the device for the regulation of the air flow delivery. Said device (not shown) may be of any well known type, and it will not be described since it is not part of the scope of the present invention. From a base wall of said casing 1 a tube 2 provided with mouthpiece 102 for the inspiration and expiration of the air by the diver branches out. On the same wall an outlet port 201 provided with a non-return valve 301 is formed, the said port 201 being in communication with the tubular element 3 through the hole 103 on the side wall of the latter facing said outlet 201. The side wall 101 of the said casing 1 presents two openings 111 in which two semiannular metal inserts 401 are fitted, whose purpose will furthermore be described. The peripheral edges of such inserts 401 are provided with enlargements 411.

The operation of the regulator according to the invention is as follows. As previously described, the regulators with a body made entirely of plastic material tend to make possible the icing on their inside, mainly due to the difficulty of compensating for the drop in temperature due to the expansion caused by the diathermic walls. Even in the regulator shown in the drawing, the expansion of the air into the regulator caused by the diver's breathing in should encourage the formation of the above mentioned ice encrustations. However, because of the metal inserts 401 embedded in the plastic walls of the body of the regulator and acting as heat-exchangers between the inside chamber of the regulator casing and the external environment, the quick re-establishment of the temperature balance inside the casing is obtained, and the freezing of the stem which is inside the casing is thus prevented. The inserts 401 are, in the case shown, two in number, semiannular shaped, but it is possible to provide only one insert, disposed near the outlet port of the supply valve (not shown), which is usually positioned radially with respect to the said box-like body. The enlargements 411 on the external edges of the inserts favour the stability of the connection with the side wall 101 of the body 1. The assembly between said inserts and said casing can be made by any known manner, and preferably said inserts are assembled to the casing during the molding operation of the casing.

The regulator according to the invention can be utilized with the same reliability as those provided with an entirely metallic body, having the merit of having been produced at greatly lower manufacturing costs.

What is claimed is:

1. A regulator for an ambient underwater breathing apparatus, said regulator comprising: a plastic body having walls forming an interior, a tube connected to said body, a mouthpiece provided on said tube, and an outlet port, a diaphragm dividing the interior of said body into a first chamber in communication with the ambient and a second chamber, wherein said body comprises at least one metallic insert integrated in the walls of said second chamber of said body so as to exchange heat with said ambient.

2. A regulator according to claim 1, wherein the body is substantially cylindrical and each of said insert or inserts is an annular sector fitted into the wall of said second chamber.

3. A regulator according to claim 1, wherein said body is made by a molding operation, and each of said insert or inserts is incorporated into said body walls during the molding operation.

* * * * *